United States Patent [19]

Wangler et al.

[11] 4,408,430

[45] Oct. 11, 1983

[54] CONSTRUCTION ELEMENTS AND JOINT CONNECTIONS FOR A DEFORMABLE STRUCTURE AS WELL AS DEFORMABLE LINE, PLANE AND THREE-DIMENSIONAL STRUCTURES

[76] Inventors: Alfred Wangler, Lettenweg 3, 7889 Grenzach-Wyhlen; Otto K. Fiedler, Rheinhohe 9, 7891 Kussaberg 1, both of Fed. Rep. of Germany

[21] Appl. No.: 146,654

[22] Filed: May 5, 1980

[51] Int. Cl.[3] ..... E04D 1/00

[52] U.S. Cl. ..... 52/585; 16/DIG. 13; 52/71

[58] Field of Search ..... 52/586, 585, 70, 71; 46/31; 16/DIG. 13, 150, 225

[56] References Cited

U.S. PATENT DOCUMENTS

| | | | |
|---|---|---|---|
| 2,266,464 | 12/1941 | Kraft | 52/586 |
| 2,978,020 | 4/1961 | Paulsrude | 16/150 |
| 3,120,078 | 2/1964 | Bessinger | 46/31 |
| 3,276,797 | 10/1966 | Humes, Jr. | 52/586 X |
| 3,516,115 | 6/1970 | Koleske | 16/150 |
| 3,670,358 | 6/1972 | Schwartz et al. | 16/225 |
| 3,747,262 | 7/1973 | Endres | 46/31 |
| 4,027,714 | 6/1977 | Dixon et al. | 16/225 X |
| 4,257,207 | 3/1981 | Davis | 52/586 |

*Primary Examiner*—Carl D. Friedman
*Attorney, Agent, or Firm*—Yount & Tarolli

[57] ABSTRACT

A construction system including a plurality of construction elements joined by removably received, flexible joining elements which allow for relative motion between adjacent construction elements.

13 Claims, 56 Drawing Figures

FIG.48
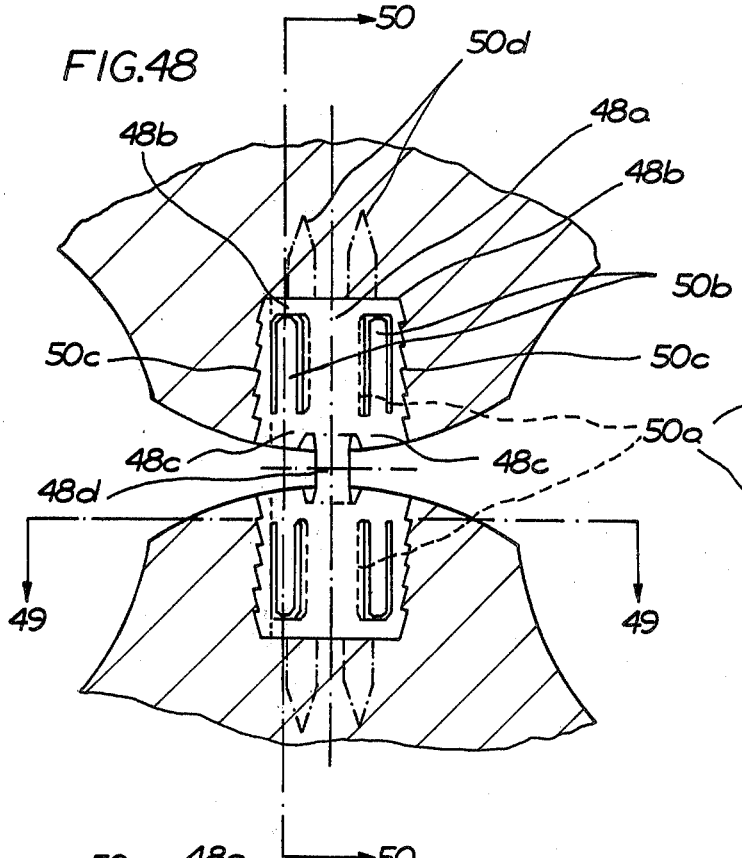
FIG.50
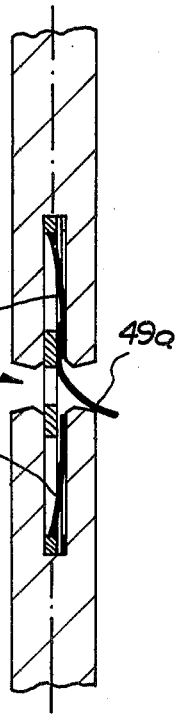
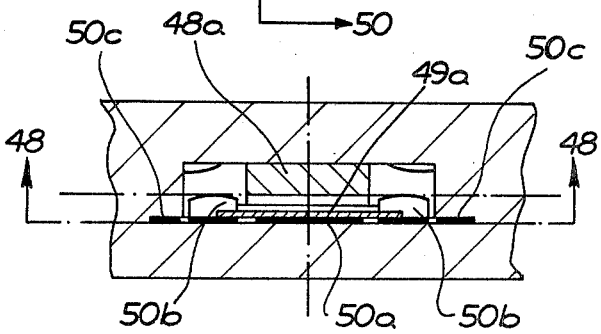
FIG.49

CONSTRUCTION ELEMENTS AND JOINT CONNECTIONS FOR A DEFORMABLE STRUCTURE AS WELL AS DEFORMABLE LINE, PLANE AND THREE-DIMENSIONAL STRUCTURES

The invention concerns construction elements for a deformable line, plane or three-dimensional structure with joint connections arranged between neighboring construction elements. The invention concerns also joint connections for such structures. A line, plane or three-dimensional structure itself also belongs to the subject of the invention.

Planar (surface) structures, and in special cases even line structures, consisting of construction elements joined together with hinging, may be used, for instance, as floor coverings, wall hangings, room dividers, as well as suspended ceiling coverings, as well as for many other purposes in interior architecture, and for industrial purposes, such as in the fortifying of earth at suspensions, slopes, and the like. In such uses, a swinging mobility of the construction elements in relation to each other around at least two axes is often important, preferably around an axis lying substantially in the plane of the surface structure, as well as transversely and symmetrically between neighboring construction elements, and additionally around a second swinging axis, running at right angles to the former, for example, through the mid-points of neighboring construction elements , which also runs in the plane of the surface structure or parallel thereto. Such a mobility makes possible an adaptation of the surface structure to surface forms, arched or otherwise curved in two directions, of a support or otherwise preceding surface form, for example, for special aesthetic effects for architectural or decorative purposes. In the same connection, there is also an expansion of the said surface structure to a three-dimensional structure to be considered, by arrangement of additional joint connections and corresponding construction elements, which are set perpendicular to the plane of a surface structure. Such three-dimensional structures may be used, especially for interior architectural purposes, with special decorative effect, perhaps as suspended ceiling coverings with suspension elements or with additional vertical surface elements, having below the covering surface itself.

Common to the present and other applications is the relatively great number of construction elements, joined together with hinging, and a corresponding, still greater number of joints between these. Accordingly, the need exists of a joint connection which can satisfy the said and other mobility requirements with relatively less production expense for the connection elements and for the construction elements themselves. The purpose of the invention, therefore, is to provide a joint connection of the kind mentioned, which is distinguished by a simple structure and permits a shaping with several degrees of freedom of setting the position of neighboring construction elements with each other.

The purpose of the invention is to provide construction elements and joint connections, respectively, of the kind mentioned and a deformable structure, respectively, by means of which a deforming, at least perpendicular to one surface extent of the structure, with a relatively small number of joints, is possible. The solution of this problem, according to the invention, is distinguished by the features of this invention.

The two solution variants are based on the same principle, namely the joining of neighboring construction elements by only one pairing of joint parts, in each case, by which a rapid and relatively simple assembly of structures of greater extension, with correspondingly many construction elements, is made possible.

The purpose of the invention extends further to the providing of a construction element which can be connected with hinging, which is distinguised by the simplicity of concave joint parts.

If desired, three-dimensional structures can also be assembled with construction elements which have at least one additional joint part.

The joint parts of a construction element may be joined to one unit by bearing bodies of different form, in which case the bearing body is to be adapted in its form to the particular use. So long as, in use, a more or less approximately closed surface development of the deformable structure is not important, but rather a net, screen or filter function, or a resilient bearing or reinforcing function, a cross or star shape development of the bearing body is recommended. The joint parts are arranged at the ends of the star or the cross. Such developments may be considered also for hanging or lying mat-form structures, which are assembled from construction elements of the present kind and may be used, for example, as room dividers or wall hangings in interior architecture, as well as floor coverings. The construction elements with cross or star form bearing bodies have here the additional advantage of a decorative appearance and versatile formability, both as to the material used and also the surface structure and constructive shaping in detail, perhaps by optical toning of the mid-point or arms of the cross or star.

A quite dense surface covering is given with construction elements having three joint parts, preferably with substantially triangular bearing bodies or with construction elements with four joint parts, preferably with substantially rectangular bearing bodies. If it is possible to do without the greatest possible surface covering, however, especially decorative designs are given by a round, circular or elliptical shaping of the bearing bodies.

The possibility, already mentioned, of expanding the construction element shaped by additional joint and connection elements into the third dimension, also opens up versatile industrial and decorative uses. In this way, for example, light hanging devices can be set onto a flat structure, without requiring more expensive additional constructions. In this connection, there should be mentioned, for example, the use of surface structures of the present construction elements as mats or net structures hung below a ceiling for the purpose of interior architecture.

In general, it may be said that as to the use of the present construction elements and the flat or even three-dimensional structures assembled from them, there are, in principle, no limitations.

A further solution of the problem of the invention is distinguished by a soft elastic or soft plastic deformable bending element, provided, according to this, in the zone of a joint point. This construction is distinguished by extremely low cost for material and production for the joint forming with fundamentally multi-dimensional swinging mobility of the joint.

An important further development of the above solution principle provides that at least one bending element is provided, extending over at least two joint places between construction elements, joined together, of the surface or three-dimensional structure. In this way, above all, the joining of the bending element with the construction element of the surface or three-dimensional structure is simplified, because corresponding joining elements are effective in common for several joint points and therefore need be present in relatively diminished numbers or extent.

The joint connection is formed, to particular advantage, of a flat, connected bending element, soft-elastic or soft-plastic deformable at least in sections, extending over a plurality of construction elements of the surface or three-dimensional structure. Here, the forces occurring in the joint connection, for instance by the weight load of a hanging surface structure, can be conducted, substantially without strain on the connecting elements, between the bending element and the construction element of the surface or three-dimensional structure, through the structure to a suspension or the like.

The invention will be further explained from the examples of execution represented in the drawings.

FIG. 1 shows the design, in principle, of four-joint construction elements and their assembly to a surface structure.

FIGS. 2 and 3 each show a top view of a four-joint construction element.

FIG. 4 is a side view of the construction element according to FIG. 3.

FIG. 5 and FIGS. 5*a* and 5*b* show the design, in principle, of three-joint construction elements and their assembly to a surface structure.

FIGS. 6 and 7 show the constructive design of a joint connection, which can swing in all directions and be detached, especially for a four-joint construction element.

FIGS. 8, 8*a* and FIG. 9 show a construction element, assembled from several parts with detachable form-fitting connection of the parts.

Figure 14:
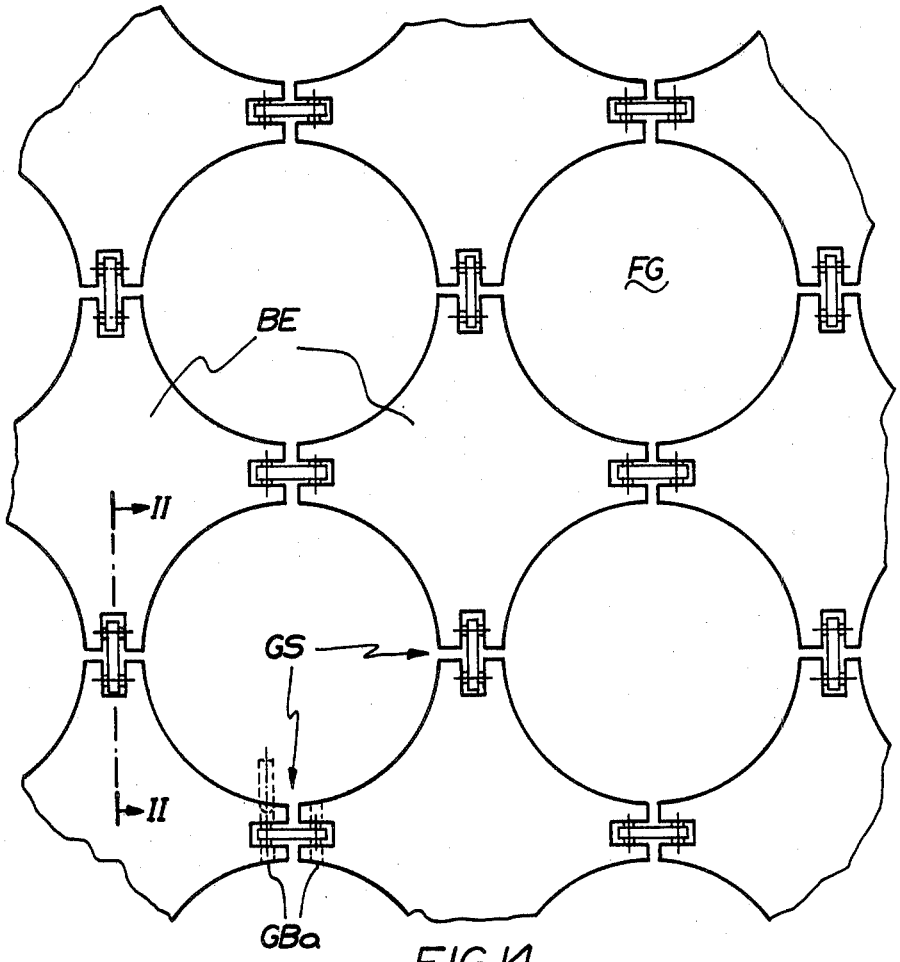

Furthermore:

FIG. 14 shows a surface structure with construction elements and joint connections acording to the invention.

Figure 15:
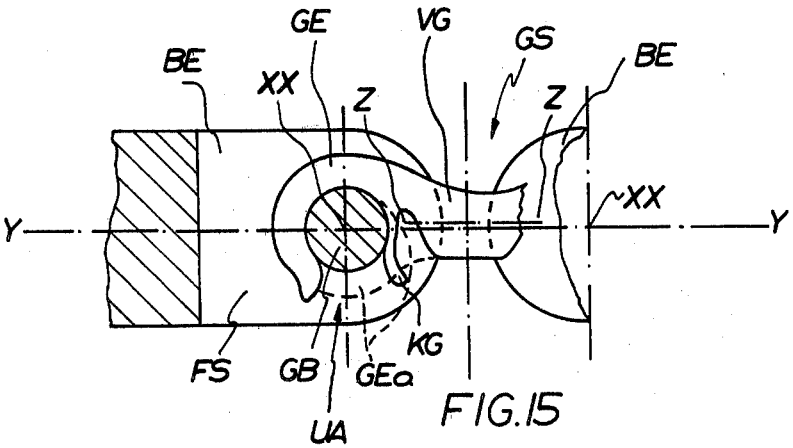

FIG. 15 shows a partial cross section of a joint connection from FIG. 14, along the section II—II thereof.

Figure 16:
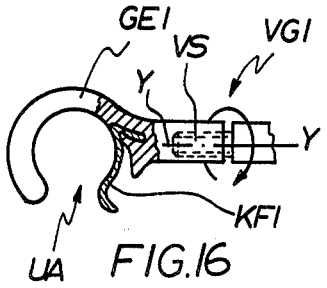
Figure 17:
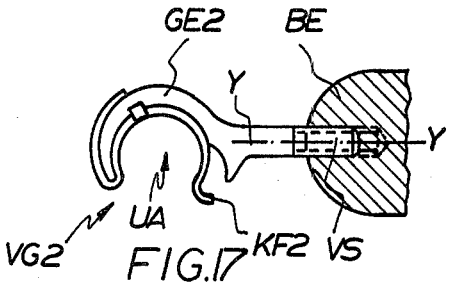

FIGS. 16 and 17 each show a design of a connecting member according to the invention.

Figure 18:
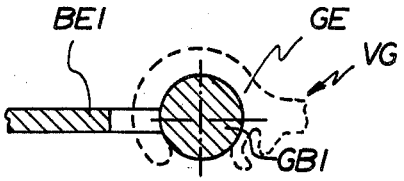
Figure 19:
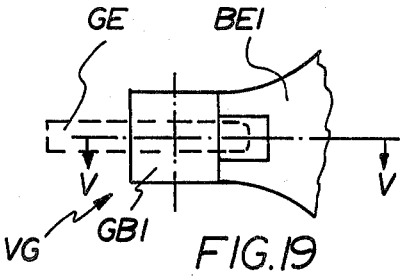

FIGS. 18 and 19 show a flat construction element with a special axial body for a joint connection, in cross section along V—V and in top view.

Figure 20:
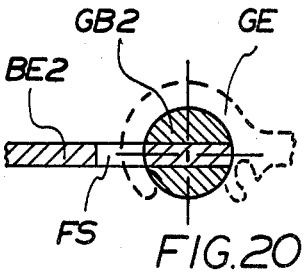

FIG. 20 shows another design of an axial body, in cross section, on a flat construction element.

Figure 21:
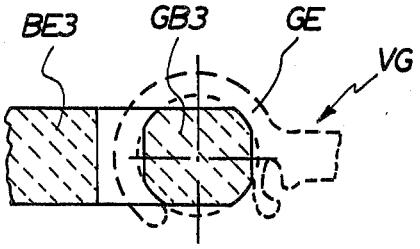

FIG. 21 shows a partial cross section of a construction element of greater thickness, with axial body.

Figure 22:
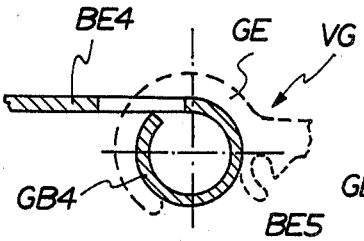
Figure 24:
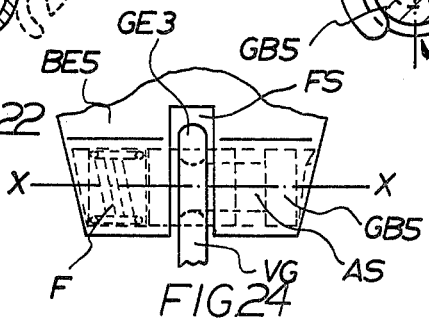

FIG. 22 shows an axial body, formed in one piece with a sheet construction element, in cross section, and FIGS. 24 and 24 show a joint connection with a movable axial body in partial cross section and in plan view, respectively.

Figure 25:
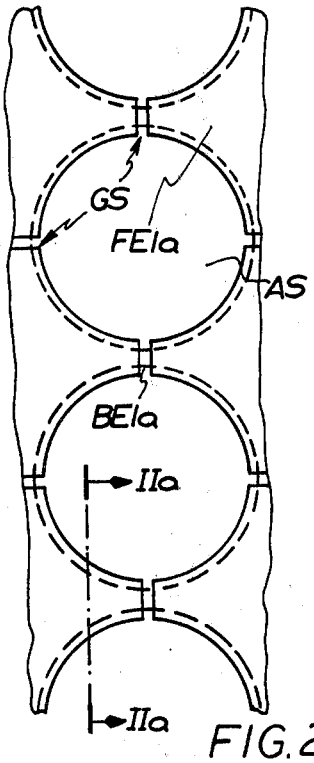

Moreover:

FIG. 25 shows a section of a surface structure of construction elements, which are joined together by a bending element, also flat, with the forming of a corresponding plurality of joint points.

Figure 26:
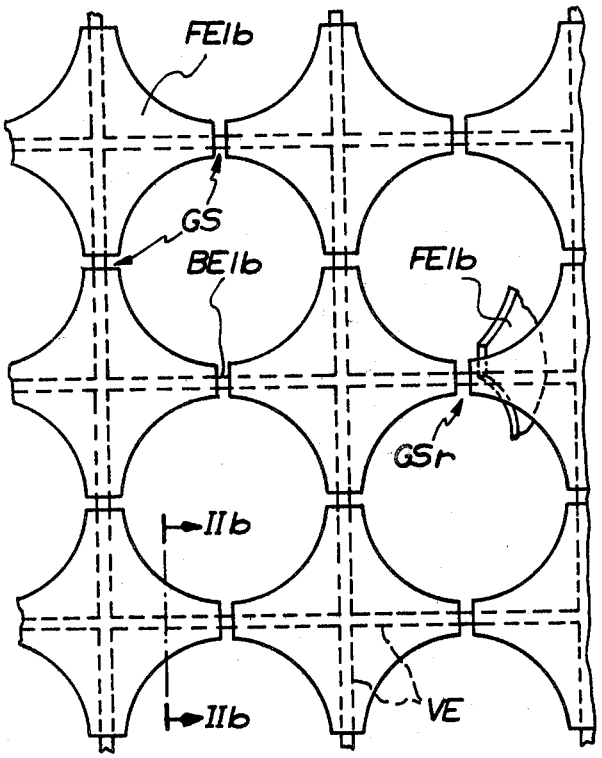

FIG. 26 shows a surface structure similar to FIG. 25, but with net-type bending elements, likewise flat as a whole, and extending over the whole surface structure, while additionally, the possibility of connecting construction elements in the third dimension is indicated.

Figure 27:
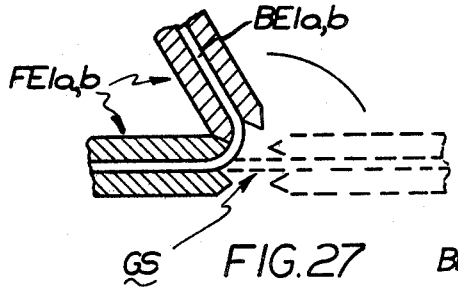

FIG. 27 shows on a larger scale the cross section of a joint from a surface structure according to FIG. 25 or FIG. 26.

Figure 29:
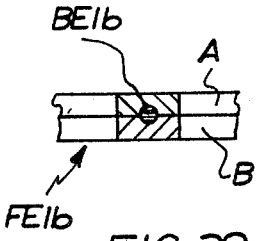
Figure 28:
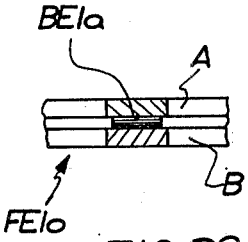

FIG. 28 and FIG. 29, respectively, show a cross section through a construction element of the surface structure according to FIG. 25 and FIG. 26, respectively, with the corresponding bending elements, along section planes II*a*—II*b* and II*b*—II*b* in these respective figures.

Figure 30:
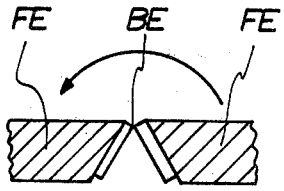

FIG. 30 shows, also on the greater scale, the cross section of two neighboring construction elements with joining bending element, in separate design for each joint.

Figure 31:
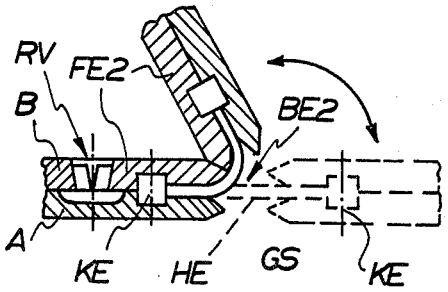

FIG. 31 shows a cross section of another design of a joint with a separate special bending element in swinging and stretch position (the latter indicated in broken line).

Figure 32:
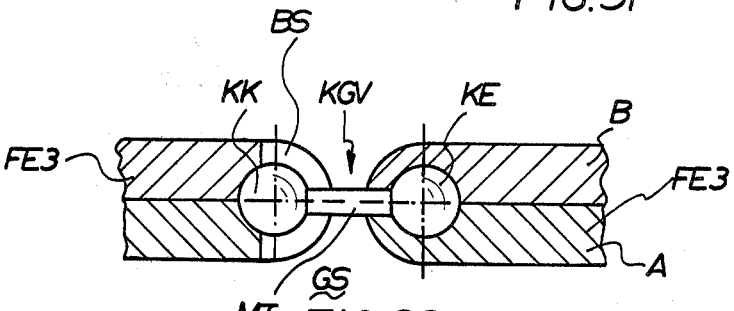

FIG. 32 shows a cross section of a joint between neighboring construction elements, with special ball-joint device.

Figure 33:
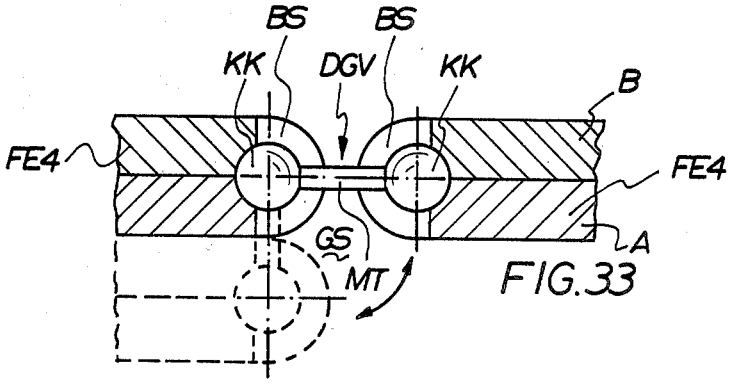

FIG. 33 shows the cross section of a design similar to FIG. 32, but with a double ball joint device joining the two neighboring construction elements.

Figure 34:
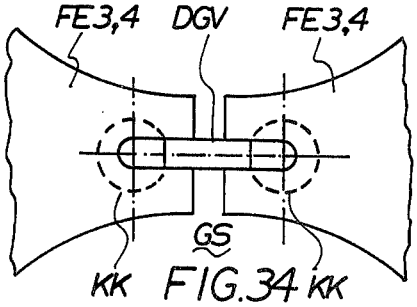

FIG. 34 shows a top plan view according to FIG. 33.

Figure 35:
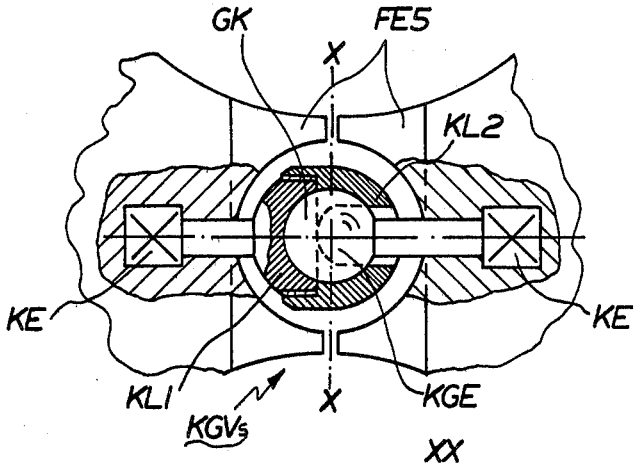

FIG. 35 shows another design of a special joint connection with a ball joint arranged symmetrically between neighboring construction elements, in top plan view.

Figure 36:
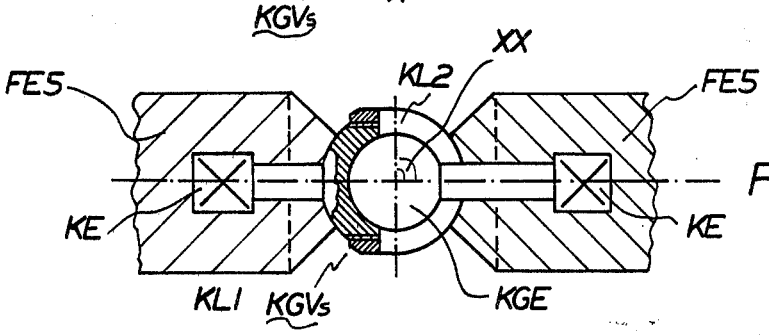

FIG. 36 shows a cross section of the joint design according to FIG. 35.

Figure 37:
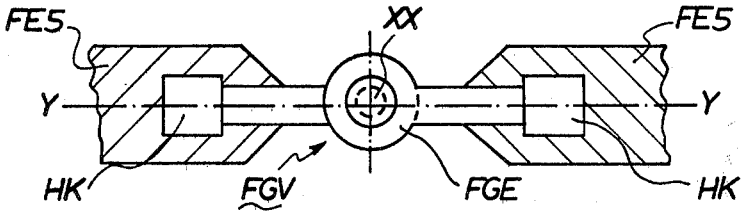

FIG. 37 shows a cross section of another joint designed with cross-joint-type swinging mobility, a swinging axis being arranged, transversely and symmetrically between neighboring construction elements.

Figure 38:
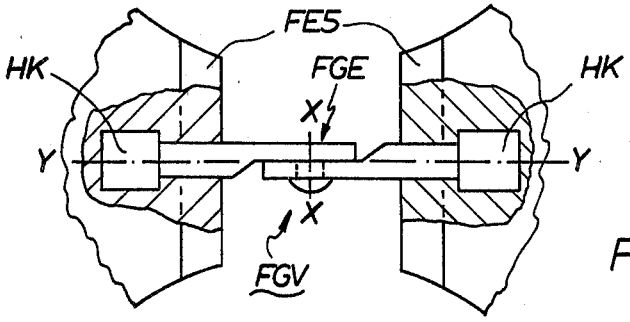

FIG. 38 shows a top plan view of the design according to FIG. 37.

Figure 39:
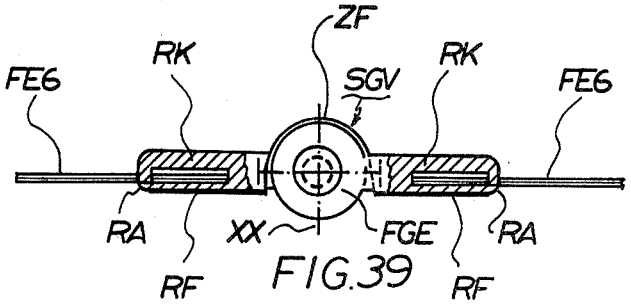
Figure 40:
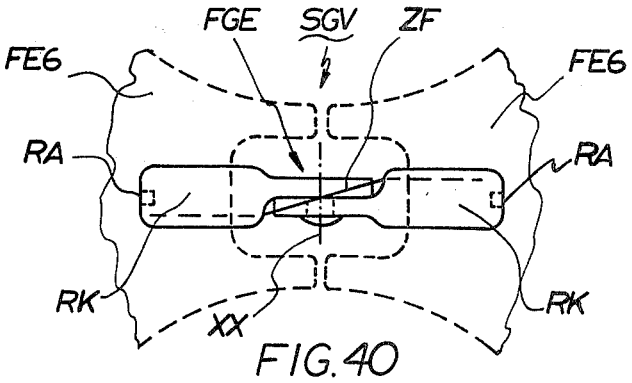

FIG. 39 shows another design of a joint device with symmetrical transversely swinging axis and easily detached snap closings, for joining neighboring construction elements, and FIG. 40 shows a top plan view of the joint connection according to FIG. 39.

Figure 41:
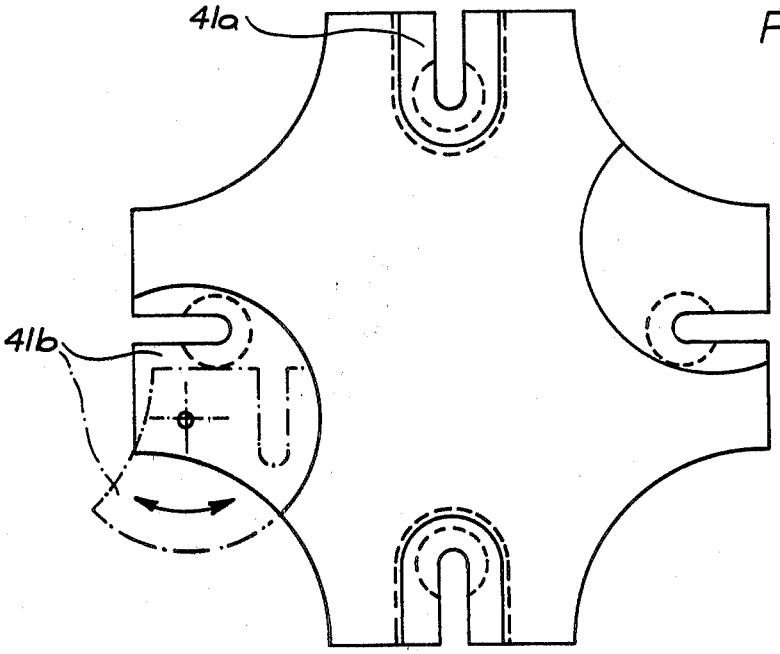
Figure 42:
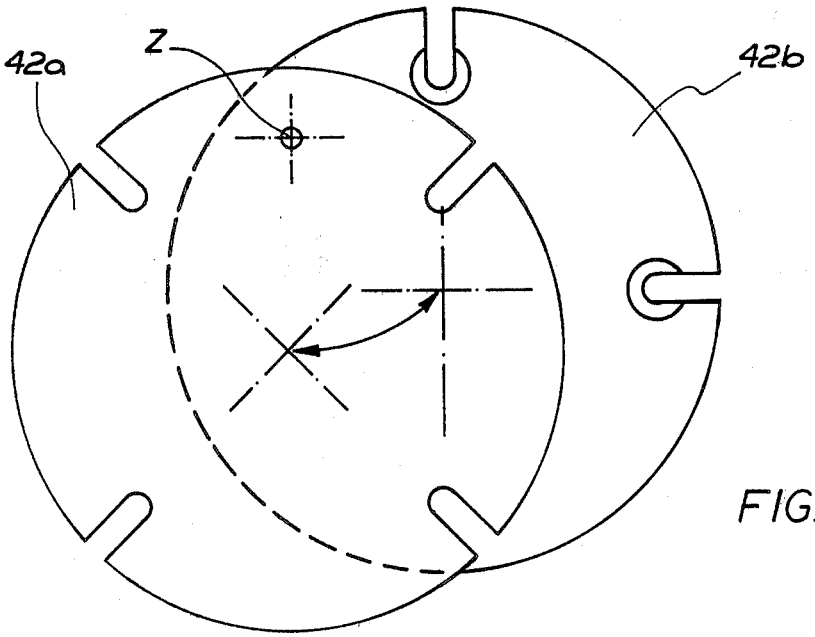

Moreover:

FIGS. 41 and 42 each show a top plan view of a flat construction element for a deformable structure with several adjustable form-fitting elements for the closing and release of joint connections.

Figure 43:
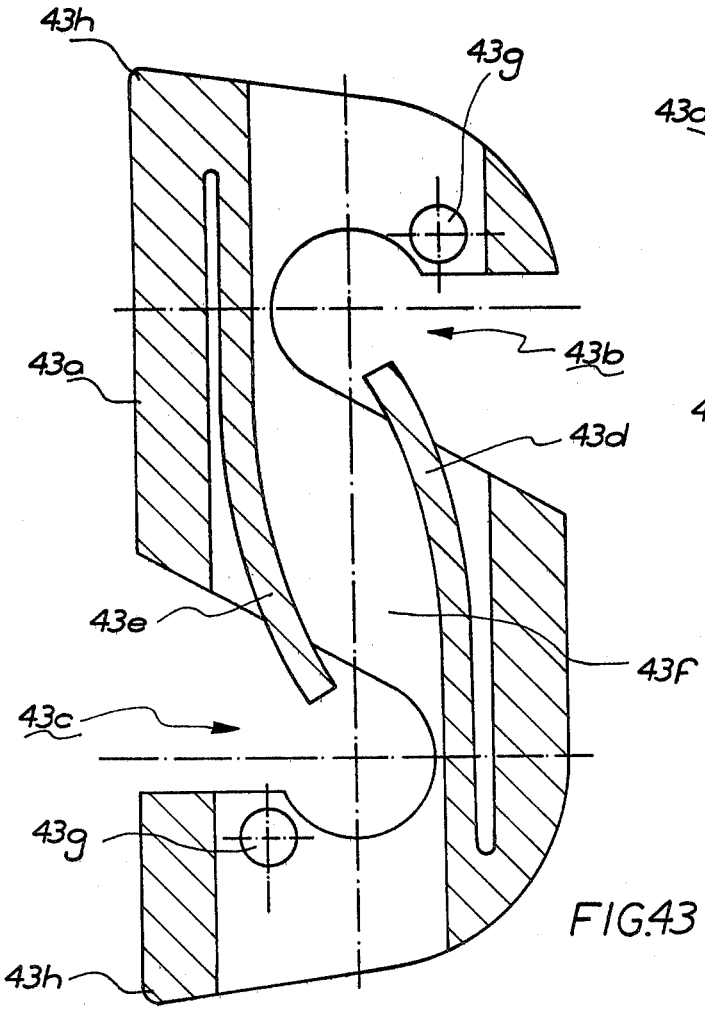

FIG. 43 shows a longitudinal section of a double joint connecting member for construction elements joined movably in relation to each other.

Figure 44:
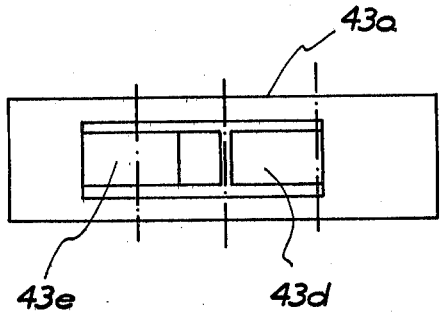

FIG. 44 is a view of the connecting member in the direction of arrow 44 in FIG. 43.

Figure 45:
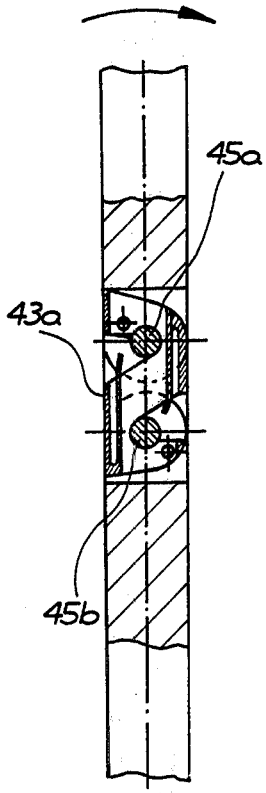

FIG. 45 shows, on a smaller scale, a partial section of two neighboring construction elements in the zone of the joint, with a connecting member according to FIG. 43.

Figure 46:
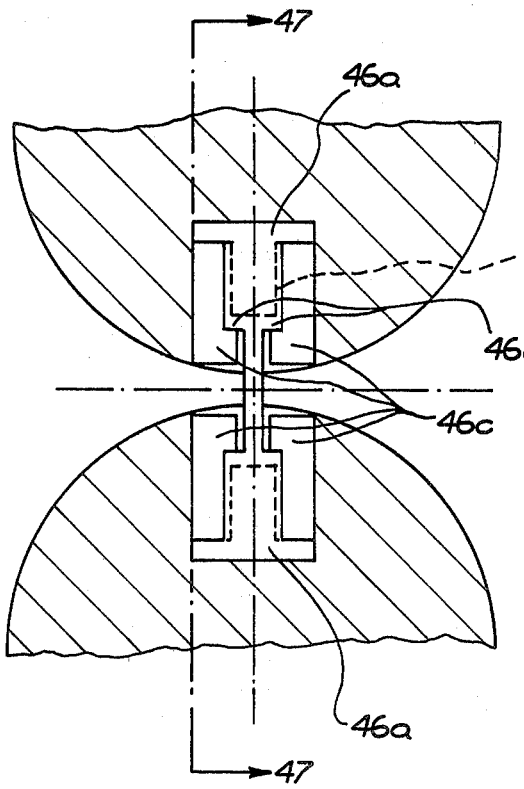
Figure 47:
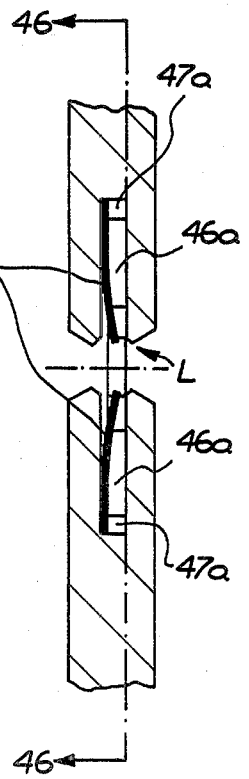

FIG. 46 shows a partial section of two neighboring construction elements, along section phase 46—46 in FIG. 47 in a joint zone with a plastically deformable connecting member.

FIG. 47 shows a partial longitudinal section along section plane 47—47 in FIG. 46.

FIG. 48 shows a partial section similar to FIG. 46, for another joint design with plastically deformable jointing member, along section plane 48—48 in FIG. 49.

FIG. 49 shows a partial cross section along plane 49—49 in FIG. 48.

FIG. 50 shows a partial longitudinal section along plane 50—50 in FIG. 48.

Figure 51:
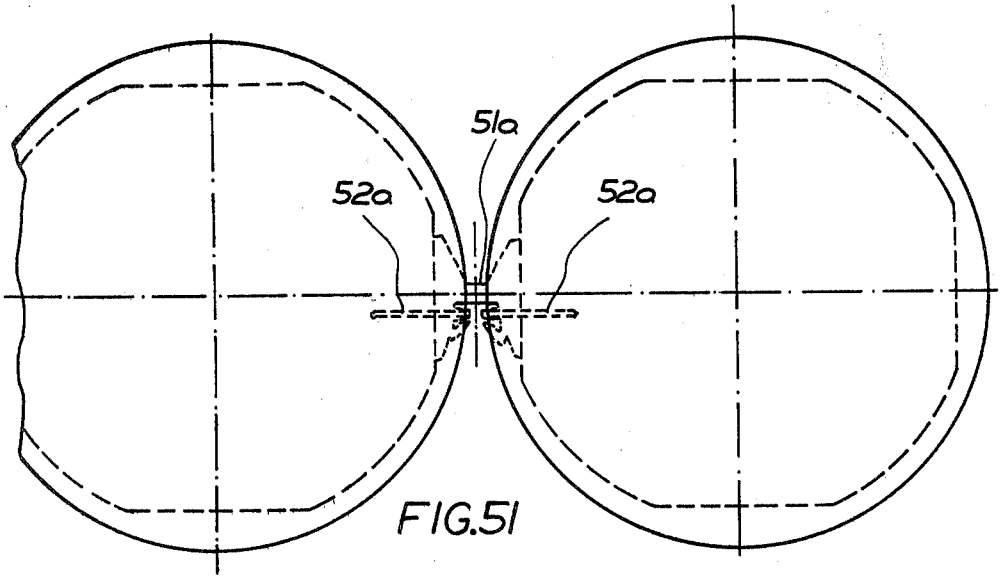

FIG. 51 shows a top plan view of two neighboring construction elements with representation of a joint zone for a third design of a plastically deformable connection member.

Figure 53:
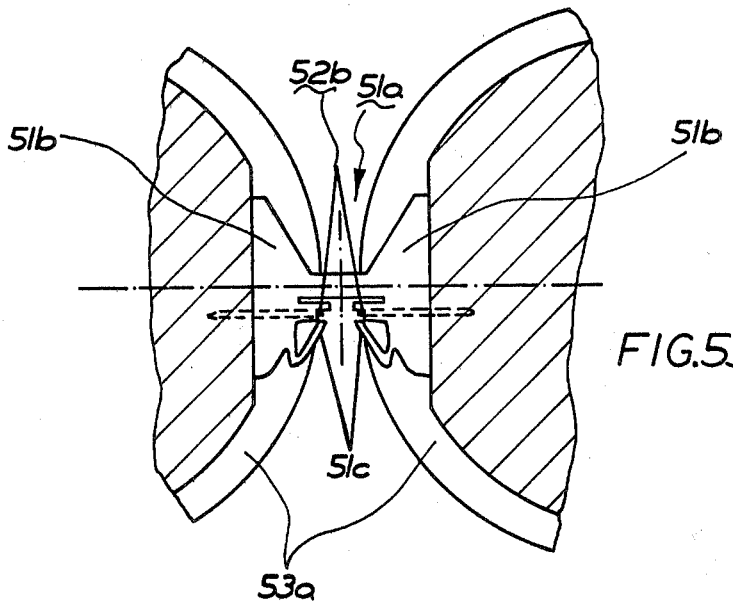
Figure 52:
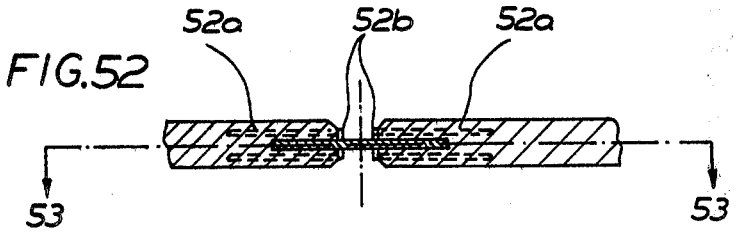

FIG. 52 shows a partial longitudinal section of the joint zone along plane 52—52 in FIG. 51, and FIG. 53 shows a partial section of the joint zone along section 53—53 in FIG. 52, and on a larger scale.

Figure 1:
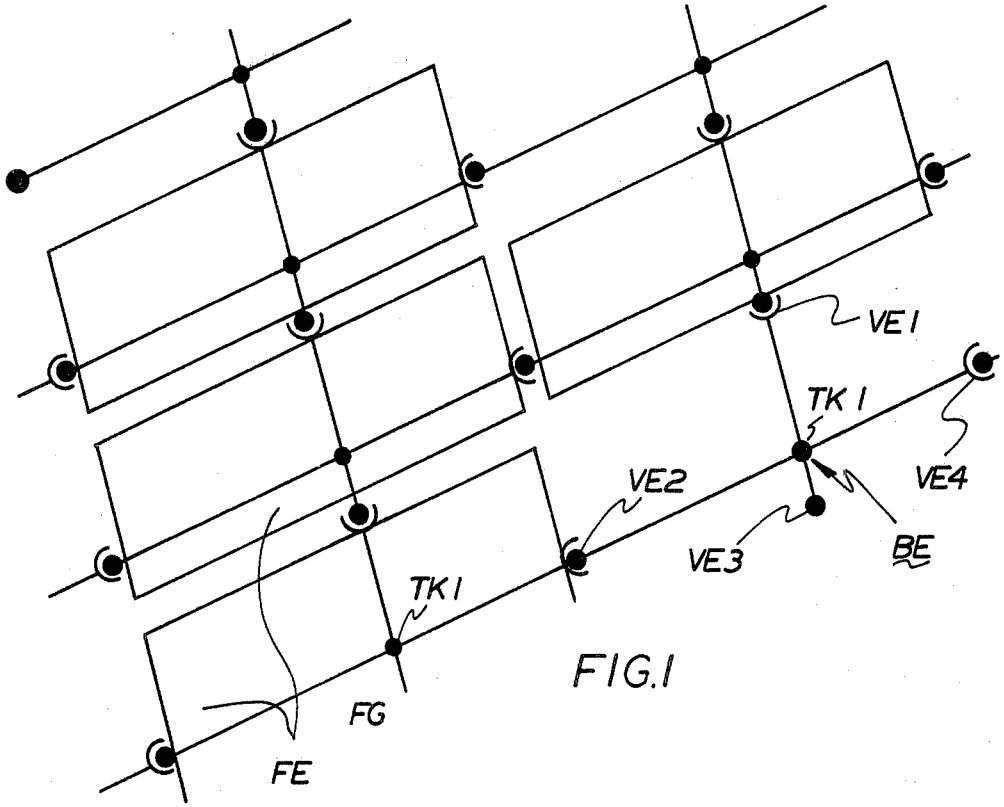
Figure 2:
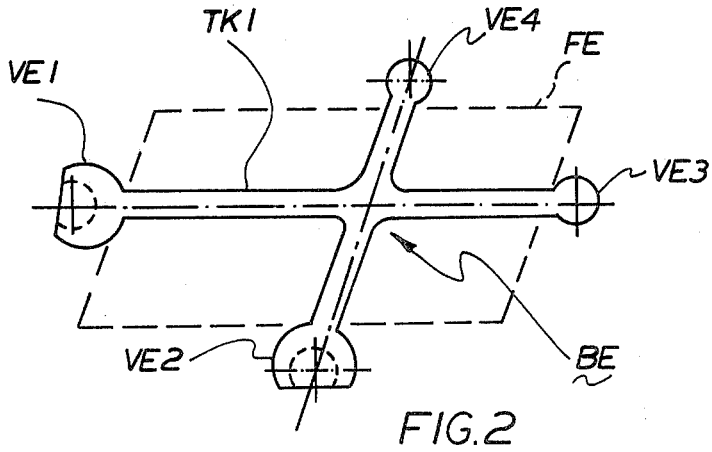

FIG. 1 shows schematically a surface structure FG, which is formed of a plurality of identical construction elements BE, each with four joint parts $VE_1$ to $VE_4$, designed as connecting elements to neighboring construction elements. In each case, two neighboring construction elements BE are joined together by only one joint, which is formed by a complementary pairing of joint parts $VE_1/VE_3$ and $VE_2/VE_4$, respectively. The complementary joint parts are designed, as indicated schematically, as balls and ball caps, respectively, and in each case arranged on sides opposite each other of a construction element. The four joint parts of a construction element are joined together, for example, by a cross-form bearing body $TK_1$, which consists, for example, according to FIG. 2, of rod parts connected in one piece. When as great a surface covering by the bearing bodies of the construction element as possible is desired, then a surface element FE, generally in the form of a parallelogram, as bearing body or as additional element to a bearing body $TK_1$ connecting the joint parts for each construction element, is to be considered, as indicated in FIG. 1 and in broken line in FIG. 2.

The construction, in principle, of a surface structure FG of four joint construction elements, according to FIG. 1, shows that a theoretically complete surface structure and, in practice, limited only by the space required for the joint parts, can be attained so long as the side edges of the surface elements FE for each construction element BE, run parallel to the connecting lines of two joint parts, in each case, which are diametrically opposite each other. Under this precondition, any desired geometric arrangement of the four joints, at least approximately in the plane of the surface structure FE, is allowable. For a freely flexible, jointed deformability of the surface structure in the direction perpendicular to its surface expanse, there are, obviously, certain conditions as to the swinging axes of the joints. For a flexibility of neighboring construction elements in relation to each other, for which, at first, for the sake of clarity, a maximum surface covering with rectangular surface elements FE according to FIG. 1 is assumed, it is necessary that each joint part forms at least one swinging axis, which runs at least approximately parallel to the connecting line of the joint parts not lying diametrically opposite the joint part in question. This condition is satisfied in each case by the ball joints, swingable to all sides, provided according to FIGS. 1 and 2, which beyond a swinging axis satisfying the above-mentioned condition, have an infinite number of swinging axes, oriented as desired in space.

Figure 3:
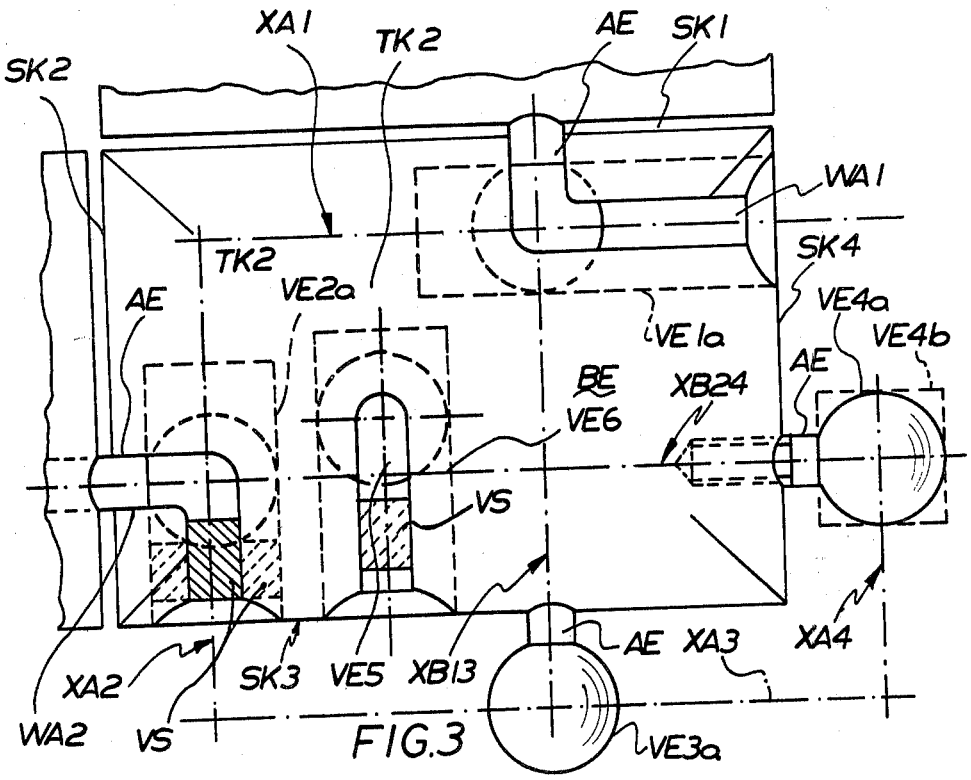
Figure 4:
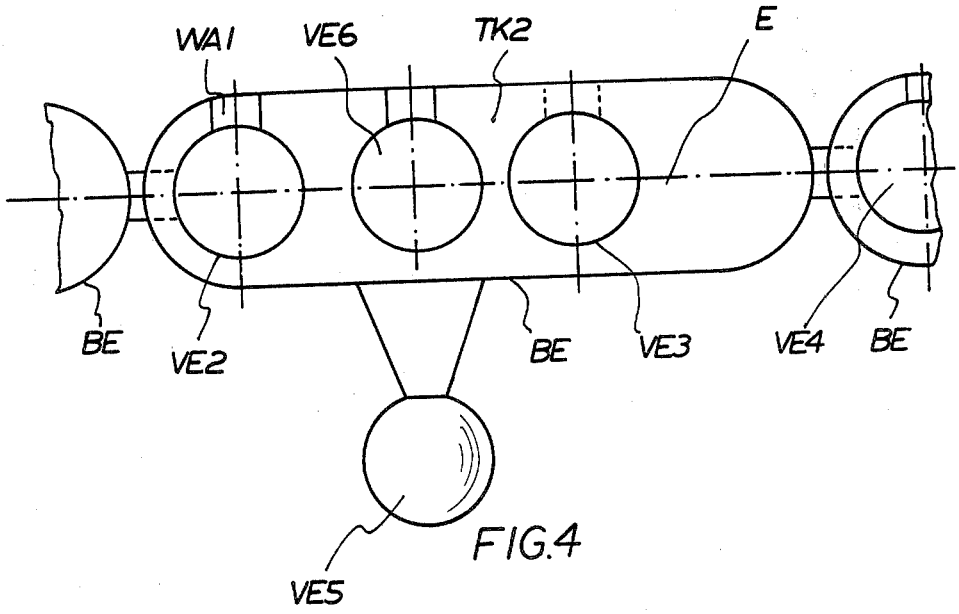

In FIGS. 3 and 4 is represented the construction of a four-joint construction element BE with rectangular bearing body $TK_2$, while in each case, on diametrically opposite side edges of the bearing body are arranged, designed complementary to each other, cylindrical concave or ball-form convex joint parts $VE_{1a}$ and $VE_{3a}$, respectively, and $VE_{2a}$ and $VE_{4a}$, respectively. The joint pairings of neighboring construction elements are formed by introducing, in each case, a ball-form joint part into a cylindrical joint part, the ball neck being guided through a slot, cut out in the bearing body $TK_2$, running parallel in each case to the cylinder axis of the particular concave joint part. Here, in each case, the construction element, with the ball joint part to be introduced, is brought into a position, rotated at right angles to the plane of the other construction element. Then the last-mentioned construction element is swung into the plane of the first construction element.

According to FIGS. 3 and 4, the axes of the hollow cylindrical joint parts $VE_{1a}$, $VE_{2a}$ are arranged parallel, in each case, to a side edge $SK_1$ and $SK_2$, respectively, of the bearing body $TK_2$. Wall openings $WA_1$, parallel to the axis of the cylinder, serve for the introduction of the neck-form connection element AE of the ball-form joint parts, while the ball-form joint parts can then be secured by setting closing elements VS into the cylinder opening or into the wall openings $WA_2$, against unintentional displacement. The swinging axes $XA_1$ to $XA_4$ of the joint pairings between neighboring construction parts are determined by slot-form openings $WA_2$, which extend transversely to the axes of the hollow cylindrical joint parts, and in each case pass through the edge of the bearing body and open at right angles into the introduction wall openings $WA_1$. In the swinging movement, thus, the neck-form connection elements AE can slide in the slot planes, that is, transversely to the plane E of the joint and the bearing body, respectively, in the present example, with a swinging angle of 180°. For this, the side edge sections of the bearing body $TK_2$ have, as shown in FIG. 4, a semicircular cross-section contour, concentric in each case with a joint axis, $XA_1$ to $XA_4$. Moreover, the joint axes run, as shown in FIG. 3, in each case parallel to a side edge $SK_1$ to $SK_4$ as well as to the connection lines $XB_{13}$ and $XB_{24}$, respectively, of the diametrically opposite joint parts, with which the above-mentioned geometric condition for freedom of movement of the joints is fulfilled.

The ball-form joint parts might also be replaced by cylindrical joint parts, lying diametrically opposite, in connection, with an ability to swing around the line of connection, as indicated in broken line, in FIG. 3, for a joint part $VE_{4b}$ with coaxial, neck-form connection element AE, screwed into the line of connection $Xb_{24}$.

Moreover, in the design according to FIGS. 3 and 4, in the zone between the joint parts lying in the plane E, parallel to this plane, another, cylindrical opening $VE_6$ is provided as a joint part for the connection of a neighboring construction element in the third dimension in relation to the plane E. An additional correspondingly complementary ball-form joint part $VE_5$ is set against the plane E, and arranged, according to FIG. 4, at a distance from the bearing body $TK_2$ and connected with the latter by an elongated neck section. In this way, the three-dimensional structures, already mentioned, can be produced. In principle, flat, as well as three-dimensional jointed structures can be produced with identical corresponding construction elements.

Figure 5:
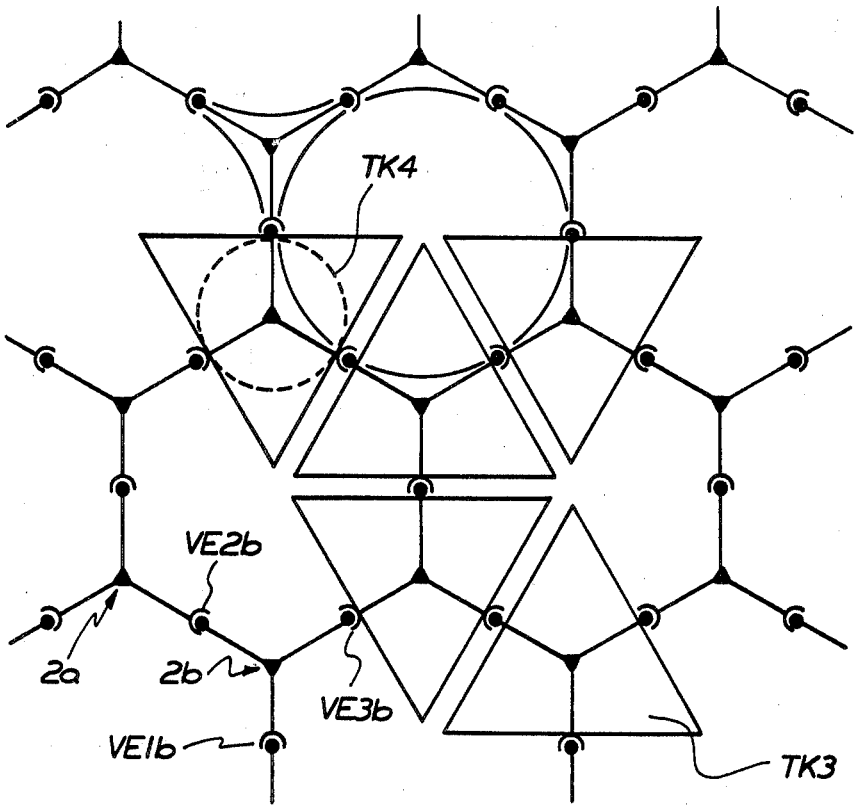

FIG. 5 shows the geometry, in principle, of surface structures with three-joint construction elements and also only one joint pairing each between two neighboring construction elements. The adjoining joint parts are again indicated as complementary ball elements which, with a projection of the bearing body from stiff, flexible material, for example, stiff, flexible plastic, have the advantage of easy production and simple assembly by the flexible assembling of bali and ball caps. For example, star shaped bearing bodies may be used as connection between the joint parts. Also, for a dense covering of the surface, the triangular flat bearing bodies $TK_3$, indicated in FIG. 5, with gap zones between the construction elements, or circular bearing bodies $TK_4$ (indicated in broken line) may be used. Ring-form perforated bearing bodies, as well as circular, round or star form bearing bodies may be provided with special decorative effects, as indicated in the upper part of FIG. 5.

Figure 5A:
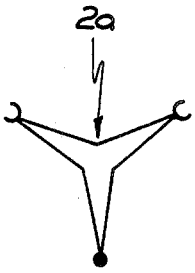
Figure 5B:
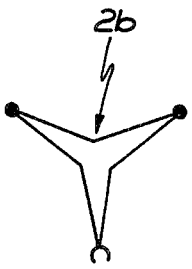

A band of three-joint construction elements, not of identical elements might also be assembled. In order to do this, complementary joint configurations 2*a* and 2*b*, as in FIGS. 5*a* and 5*b*, respectively, are necessary.

Figure 6:
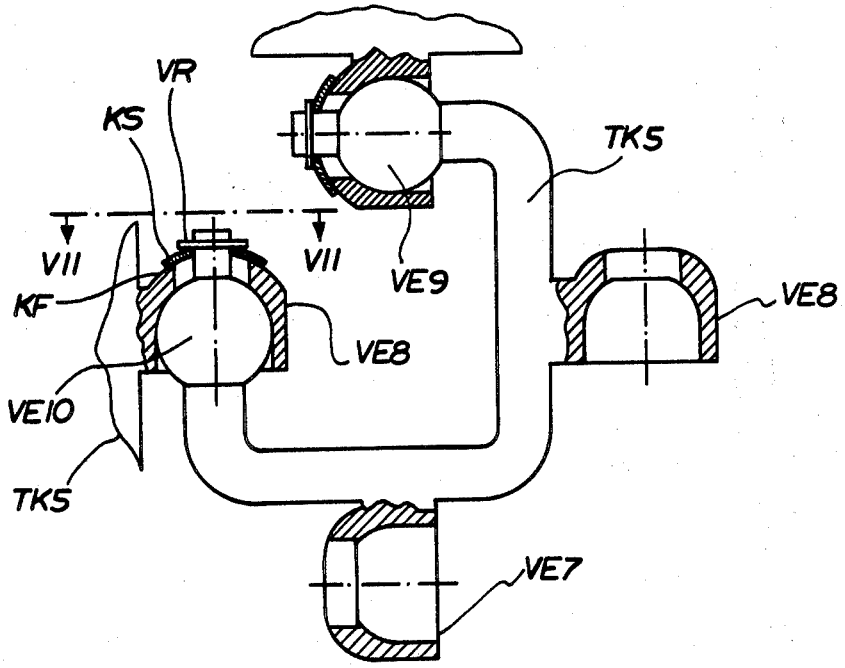
Figure 7:
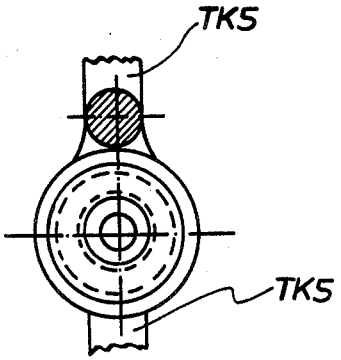

FIGS. 6 and 7 show a construction element with a bow-formed bearing body $TK_5$ and ball-form joint parts $VE_7$ to $VE_{10}$. The concave joint parts are designed as caps, free from decoupling, which make possible a simple production and assembly free of deforming. For this, cap discs KS are provided on the convex joint parts, which cooperate with an outer cap surface KF of the opposite piece and are secured by a lock VR.

Figure 8:
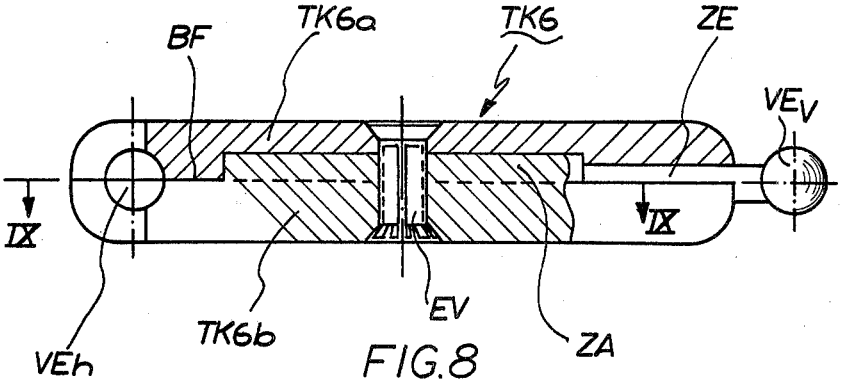
Figure 8A:
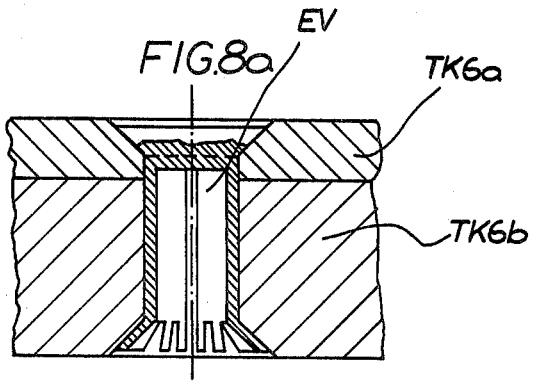
Figure 9:
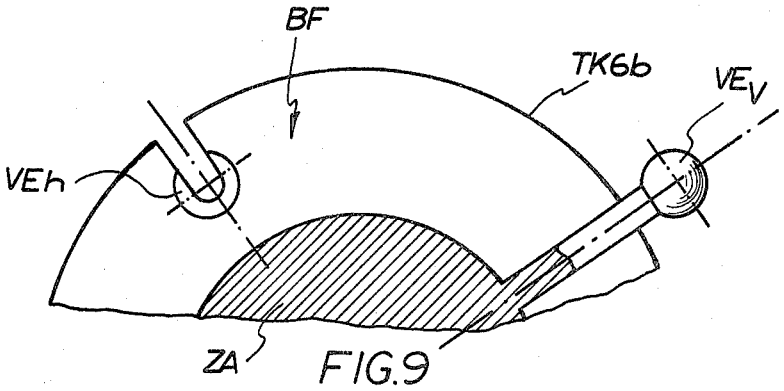

The design according to FIGS. 8, 8*a* and 9 has a bearing body $TK_6$ which consists of two body parts $TK_{6a}$, $TK_{6b}$, secured in relation to each other by a centering piece ZA and stopped by projections ZE against mutual rotation. These parts may be made free from decoupling and are joined together, form-fitting and detachable, through an elastic deformable locking element EV. On the other hand, the division surface BF, for example, may be used for a non-detachable gluing of the bearing body. In any case, the concave and convex joint parts VEh, VEv are made free from decoupling.

Figure 10:
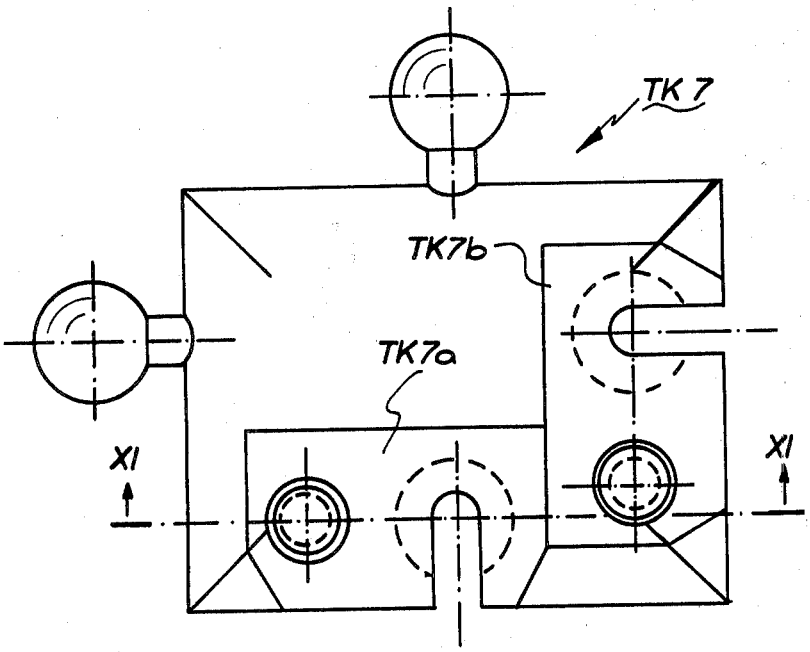
FIG. 10 shows another design of an assembled construction element in a top plan view.
Figure 11:
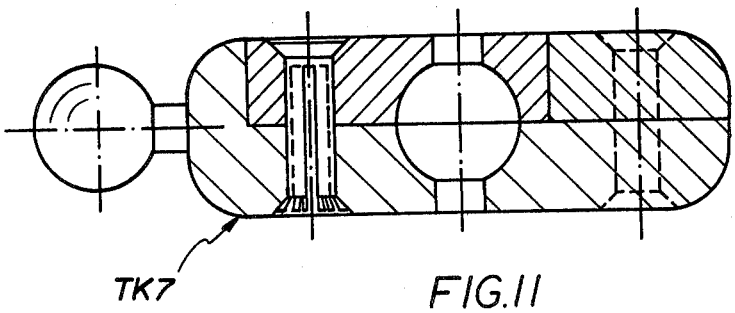
FIG. 11 shows a cross section of the construction element according to FIG. 10 along section plane XI—XI in FIG. 10.

The design according to FIGS. 10 and 11 has also a bearing body $TK_7$, of several parts, with a body part $TK_{7a}$, $TK_{7d}$ for each ball cap. In this way, the advantage is given of an easy assembling, because the individual joints can be assembled in succession. Here also, a detachable as well as a permanent joining of the body parts may be used.

Figure 12:
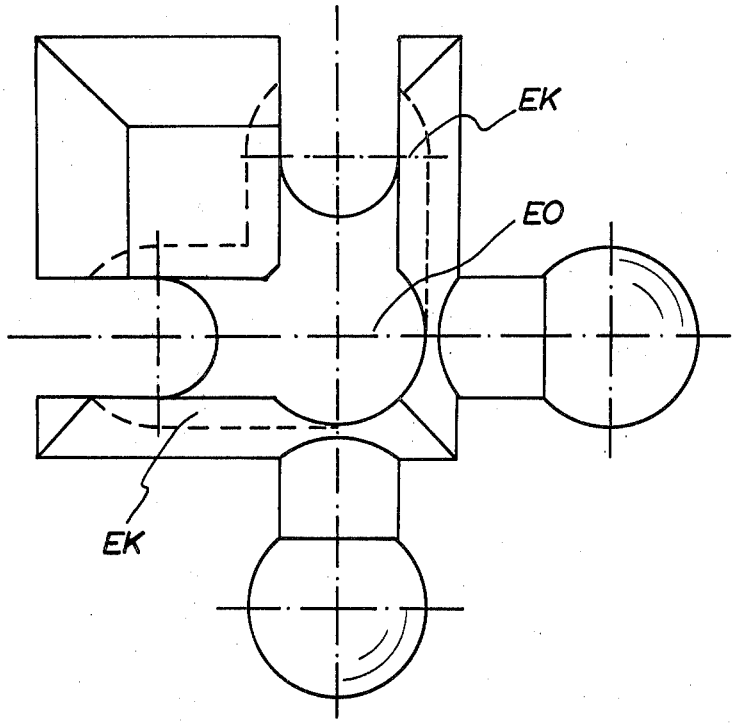
FIG. 12 shows a construction element in top plan view for a joint connection for only one additional element.

The design according to FIG. 12 has an introduction opening EO with connecting ball introduction channels to the cap joint parts. The introduction opening may be filled by an elastic sealing element, not shown.

Figure 13:
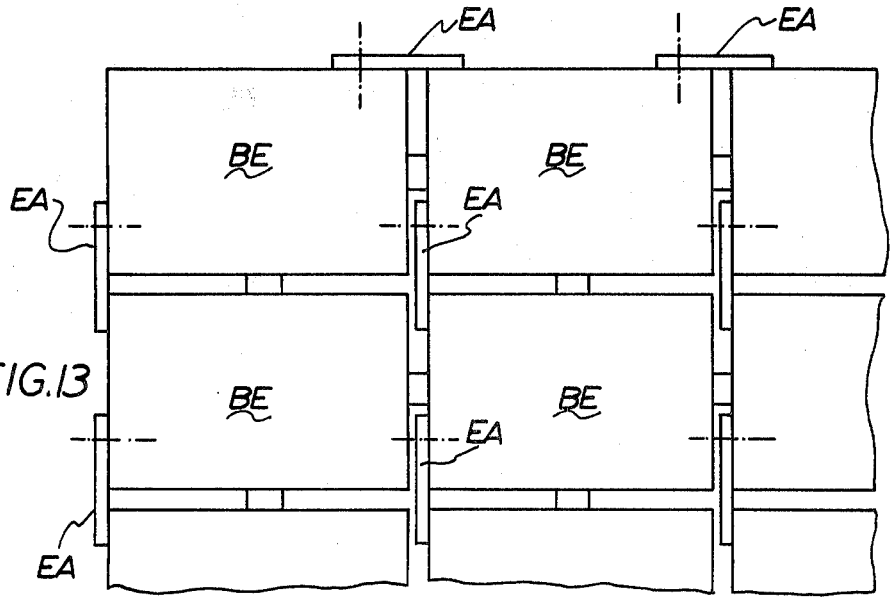
FIG. 13 shows a schematic plan view of a jointed deformable surface structure, secured against loosening by additional stop elements.

FIG. 13 shows a band of four-joint construction elements BE, for example, those shown in FIG. 18, which can be assembled by mere displacement in the surface plane and are detachable. Edge-limiting elements, placed after assembling, secure the joint structure, however, against unintentional loosening even with great deformation.

FIG. 14 shows a joined band of construction elements BE with joints GS in the form of a surface structure FG. According to FIG. 15, the joint connection has a dumbell-shaped double joint connection member VG with the hooked joint elements GE, corresponding to two joint axes XX, which are each formed by an axle body GB. Through a circumferential opening US, the axial body is introduced into the joint element under elastic deformation of a clamping member KG, formed in one piece with the connecting member. Finally, the joint element rests so as to be swingable on the axle body, which is surrounded over more than half its circumference by joint elements and the latter bears, therefore, secured against transverse displacement. Swinging around an axis ZZ, parallel to the line of connection YY of the neighboring construction elements BE is possible through elastic torsion-soft shaping of the connection member or its middle part.

The design shown in broken lines in FIG. 15 shows a ring-form closed joint element GEa, for the assembly of which, according to FIG. 14, axle bodies TBa, which can be pushed along, are provided.

FIGS. 16 and 17 show designs of a connection member VG1 and VG2, respectively, with double and single joint, respectively, and separately placed, resilient clamping elements KF, and KF2, respectively, and with screw joint VS for the swinging support around the connection line axis YY. This design is especially suitable for production by metal casting or forging techniques.

The resilient clamping elements are in each case arranged on the side of the joint element or the respective circumferential opening UA, which in case of a pulling load on the connection, that is, in reference to a mutual spacing of the construction elements, is relieved of tension. In this way, the side of the joint element, strained in bending, can be designed stiff and sufficiently resistant to bending, without impairing the function of the catch connection.

The one-joint connecting member VG2, according to FIG. 17, is connected through the screw joint VS directly with a construction element BE.

FIGS. 18 to 22 show directly understandable designs of axle bodies, formed in one piece on a construction element BE1 and BE4, or set onto the latter (FIG. 20), for coupling with joint elements GE with catch connection. The axle body designs GB1 and GB2 project beyond the thickness of their respective construction element, while the design GB3, especially for wood, for example, is flush with the thickness of the construction element and has cut edge portions so as to approach a round cross section. The joint elements move, in all cases, in receiving or guide slots FS of the respective construction element. The design GB4 is intended for a production by circular bending of a section of the construction element consisting of sheet metal.

Figure 23:
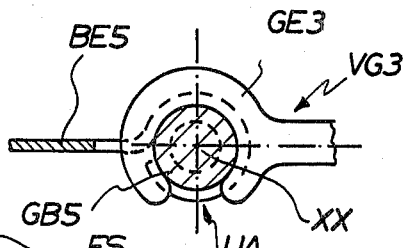

The joint connection according to FIGS. 23 and 24 has a rigid joint element GE3 as well as an axle body GB5, supported and movable lengthwise in a socket of the sheet metal construction element BE5, with pretensioned spring F and the section AS, diminished in diameter, adapted to the circumferential opening UA of the joint element GE5, for setting in the connecting member. For assembly, the axle body is pushed in the direction of the axis XX against the spring F, until the section AS lies in the zone of the slot FS, and the hooked joint element GE3 can be introduced; then the axle body is released and locked under the action of the spring F.

In FIGS. 25 and 26 are represented surface structures of star-shaped flat elements FE1a and FE1b, respectively, with a joint point GS each, between neighboring surface elements.

In the design according to FIG. 25, a bending element BE1a, passing, in one piece, over the surface structure, with circular openings AS, for example, corresponding to the outline of the surface elements, is provided. In the zone of each joint point GS, the section of the bending element situated there gives an elastic or plastic swinging mobility of the neighboring surface elements in relation to each other, as indicated, enlarged, in FIG. 27. The same cross sectional representation according to FIG. 27 applies also to the design according to FIG. 26, where a net-type bending element BE1b, with rod, cord or thread-form bendable connecting elements VE, is provided, which in the zone of each joint point GS gives the desired swinging mobility. In FIG. 26 is indicated, also, at a joint point GSr, the possibility of the additional attaching of a surface element FE1b in the third dimension, with the aid of a corresponding three-member branching zone of the bending element. With this, three-dimensional structures can be produced in many forms. The third cord of the bending element, branching into space, may be added, for instance by welding on, by gluing on, or even by forming in one piece on the cords of the bending element running in the plane of the surface structure. FIGS. 28 and 29 show, for this purpose, the arrangement of the bending elements BE1a and BE1b, respectively, in an interspace, in each case, of two parts A and B, joined together, of a surface element, FE1a and FE1b, respectively, which can be joined together and possibly, especially in the design according to FIG. 28, also joined with the bending element arranged between bonded material, especially by gluing, welding, or the like.

Especially for a design with a bending element consisting of flat material, it is possible to produce a permanent swinging position of two neighboring surface elements in relation to each other by simply swinging the elements. In this way, there may be produced, in sections or even larger surface zones, arched or otherwise curved in two dimensions, forms of surface structure, which may be desirable for decorative purposes. For example, thin sheets of metal may be used as a bending element.

FIG. 30 shows a design with a bending element BE in the form of a so-called foil joint, with a grooved thin place and fastening flaps on both sides, which latter are fastened to adjoining end surfaces of neighboring surface elements FE, for example by gluing. The end surfaces are suitably beveled toward the surface or element plane, so that a swinging movement to both sides is possible.

In the design according to FIG. 31, a bending element BE2 in special design is provided for each joint point GS. The bending element has a soft-deformable neck element HE with head elements KE on both sides, which are imbedded in corresponding openings within the neighboring surface element FE2, and produce the joint connection. In this case, an assembly of the surface element from flat parts A and B, similar to the design according to FIGS. 25 and 26, is provided, while the bonded material connection of these parts, already mentioned, may be used. On the other hand, a catch connection RV may also be considered, with which the parts A and B can be joined detachably with each other.

In the design according to FIG. 32, a ball joint device KGV, designed as a separate part, is provided for each joint point GS, with head elements set on both sides of a middle part MT, for joining with neighboring flat elements FE3. One of these head elements is designed as a ball head KK and is set into a corresponding cap opening with movement slot BS of one of the two surface elements, and forms a joint which can swing around two axes at right angles to each other. The other head element KE is designed in ball form also, for simplicity, but is set into a corresponding opening, without movement in a slot, of the respective surface element, so that the joint point has only one joint, with joint axes intersecting at right angles.

The design according to FIGS. 33 and 34 is similarly constructed, but both head elements of the joint device act as ball heads KK, so that, in all, one double joint device DGV is formed, with correspondingly widened possibilities of movement of the surface elements FE4 in relation to each other. In particular, the surface elements may be swung by 180° into parallel position, as indicated by broken lines in FIG. 33.

The dumbbell-form design of joint devices, as represented in FIGS. 30 to 34, is distinguished by especially simple shaping and less expensive production. It combines, in the two-end head elements, the function of connecting the jointing members. The holding function of such a dumbbell-form member may also be used, to advantage, in combination with other kinds of joint design. Such a design is shown by FIGS. 35 and 36, as well as 37 and 38. Here a ball-joint device KGVs and FGV, respectively, is provided, of which the swinging axis XX is arranged, running transversely to the connection line of two neighboring surface elements FE5 and FE6, respectively, or parallel to neighboring contour sections of the adjoining surface elements, and symmetrically between the neighboring surface elements. In this way are formed within the whole surface structure, especially uniform and aesthetically pleasing possibilities of swinging or deforming.

In the design according to FIGS. 35 and 36, a joint which can swing to all sides is provided, with inner ball joint element KGE and two outer cap elements KL1, KL2, screwed together. The fastening into the surface element FE5 takes place, for example, with cubic head elements KE which themselves have no mobility within their receiving part. In the design according to FIGS. 37 and 38, on the other hand, a symmetrically arranged, flat joint element FGE, with only one swinging axis XX is provided, the desired swingability being realized, around an axis YY, perpendicular thereto, corresponding to the connection line of neighboring surface element FE5, by cylindrical design of holding heads HK on both sides. This design is distinguished from that according to FIGS. 35 and 36, by simpler shaping and production. While with a movable mounting of both holding heads HK, a corresponding swinging of the joint device FGV as a whole, in relation to both neighboring surface elements is given, with the same mobility of these surface elements in relation to each other, one movable mounting of only one head in the respective surface element may also be considered. If desired, other than cylindrical forms may be considered for the holding heads, even a ball form, in which case only the swinging around one axis is used. Generally, in this connection, only one head movement, rotation about the axis YY, is important.

The design according to FIGS. 39 and 40 shows a joint device SGV for the connection of relatively thin-walled surface elements FE6, with a one-axis flat joint element FGE, corresponding to the design according to FIGS. 37 and 38, but with detachable catch connections to the surface elements on both sides, which are formed by a catch head RK with catch spring RF which can be elastically bent. Cross projections at the ends of the catch head RK each engage in an opening RA of the respective surface element and thus produce a form-fitting but detachable connection. The holding security of this connection is reinforced, in the present case, by a spring wire ZF. This joint device permits, in itself, only one swinging movement around the axis XX, but the whole body of the device, or at least its middle part in the zone of the joint element FGE may be designed torsion-soft, so that a mobility corresponding to the design according to FIGS. 37 and 38 is given, with two swinging axes at right angles. For this, a design of soft deformable material, such as soft, flexible plastic or the like, may be used to form the joint.

The catch connections according to FIGS. 39 and 40 are ring-form holding elements which are connected with the surface elements on both sides. It should be noted that the head elements of a dumbell-form connection device may also be designed fundamentally ring-form, such as circular ring-form, and may be set into corresponding openings of the surface elements. For this, in turn, there is a separation of the ring elements as in FIGS. 39 and 40, but also a corresponding yielding development and division of closed ring heads in the manner of a catch connection can be set into the surface elements. Other ring-form embodiments of separate connection devices may possibly be considered, to advantage, and fall under the subject of the invention, in principle.

Finally, it should be mentioned that the term "surface element" used in the description of the examples is used in the narrower sense for the embodiments shown, but, in general, any formed construction element of surface or three-dimensional structures may be assembled in the same way by the joint connections of the present kind.

FIG. 41 shows a construction element for a deformable structure with several form-fitting connections, which can be closed and released by hand, namely a slide 41*a*, movable in a straight line in the radial direction of the cross-form construction element and a rotary slide 41*b*. These slides are used for closing ball caps for double joint connections in the manner of FIGS. 33 and 34. The slide 41*b* has the advantage that it cannot be lost, and grips over the contour of the construction element relatively little. Both designs permit a setting in and release of a construction element in a closed band, that is, without loosening the whole structure.

FIG. 42 shows in turn a rotary slide embodiment, but the construction element is divided into two slide-form parts 42*a* and 42*b*, which both have the outer (here circular) contour of the construction element. Both slide parts are mutually swingable around an eccentric axis Z, so that, again, joint caps in the manner of FIGS. 33 and 34 may be opened to receive the joint heads and closed, respectively.

Moreover, the closing element 41*b* and 42*b*, possibly instead of swinging, may be designed as thin elastic flexible discs. By raising the disc at the edge, the caps for setting in a joint head can be opened.

FIGS. 43 to 45 show a further-developed double-joint flap for connections in the manner of FIGS. 14 to 24. The flap body 43*a* has openings at the side, 43*b* and 43*c*, for the introduction of axle bodies 45*a*, 45*b* of neighboring construction elements 45*c* and 45*d*. These openings are closed automatically, after introduction of the axle bodies, by spring tongues 43*d* and 43*e*, which are formed in one piece on the flap bodies and act as catch elements. This automatic action against removal to the side of the axle bodies is given by the forming of the end section of the spring tongues, directed toward the middle of the axle. On the other hand, the tongues can easily be swung by hand into the inner space 43*f* of the flap body, by pressure on their end sections in the circumferential direction of the axle body, perhaps by means of a simple, pin-form tool. With this, the form-fitting connection is released and the axle body can be removed to the side.

By the arrangement of the spring tongues in the inner space of the flap body, there is given not only an aesthetically pleasing appearance, but also a support of the tongues against excessive load and deformation.

Openings 43*g* on the hook-like flap heads provide for an additional elastic yielding in inserting the axle bodies. For low loads, this elasticity may suffice for the catch connection, so that the spring tongues are eliminated and an especially simple forming is obtained.

Projecting corners 43*h* of the flap heads, as can be seen from FIG. 45, have the effect that the construction elements 45*c* and 45*d* can only be swung mutually in the direction indicated by the arrow, from the stretched position. In the opposite direction, a rigid support is given. This is important, for example, for the forming of folding walls and the like, in which the flaps for forming the folds are alternately reversed.

The embodiment shown is suitable also for a one-piece production of the flap with the spring tongues by plastic injection molding.

The connection according to FIGS. 46 and 47 has a flap 46*a*, which in its middle section is designed plastically flexible and twistable, and is set, by head sections 47*a* on each side, into flat rectangular openings of the neighboring construction elements and supported therein against torsion and bending. Parallel to the flap, a flat spring element 46*b* with a flexible spring section 46*c* on each side is set into each of the two construction element openings. Projections of the flexible spring section directed inward, after pushing in the flap heads, grip their shoulders 46*d* and give a form-fitting catch, by springing up in the direction transverse to the plane of the flap, as shown in FIG. 47. By light pressure on the end section of the flexible spring section 46*c*, accessible from the edge of the construction element, in the direction of arrow L in FIG. 47, the catch connection can be released. For the springing catch connection, the flexible spring sections are formed in a deflected position relative to the plane of the flap. The flap is suitably given at both its side edges, a beveling (not shown), which facilitates insertion with bending back of the flexible spring section into its flat position. The spring sections may also be formed with a torsional deformation, which also makes possible a springing out from the flat position, with engagement of the spring projections against the shoulders of the flap.

The flat spring element is suitably joined permanently at its flat surface sections with the neighboring inner wall of the construction element opening. With this, the flexible spring section remains free of the gluing and keeps its mobility. The flap may be supported at the side, against the walls of the construction element opening, through stiff flexible spring sections in a direction parallel to the plane of the flap, so that a support is also given for plastic bending of the middle flap section in a direction parallel to the plane of the flap.

If desired, such a flat spring element may be widened by side sections, angled from the plane of the flap, without departing from the meaning of the term "surface element". Such angled sections may be used for the forming of additional gluing surfaces or for other kinds of fastening to the construction element, especially for a side support of the spring tongues with softer material of the construction element. A non-symmetrical, especially a one-side arrangement of the spring elements or spring sections, in relation to the line of connection of neighboring construction elements, may be considered also.

Unlike the connection according to FIGS. 46, 47, the flat spring element 50*a* of the design according to FIGS. 48, 49, 50 has flexible spring sections 50*b* which can be pressure-stressed in their lengthwise direction, as can be seen from FIG. 50, which spring out from the position parallel to the plane of the flap, and at the backward projections 48*b*, grip a flap 48, which can be bent and twisted in the narrower middle section 48*d*, as in FIG. 46, and thus form a catch connection. By pushing in a probe 49*a*, consisting of elastic thin sheet metal, between the flap and the flat spring element, the flexible spring section 50*b* can be bent back into its flat position, so that it is free of the projections 48*b*. With this, the catch connection is released and the flap can be removed from the opening of the construction element.

The direct and strong support of the flap 48*a* in the side direction, even in the zone of the opening, through further projections 48*c* of the flap body is advantageous in this design. This gives an especially secure support to the flap under bending stress in a direction parallel to the plane of the flap and also an aesthetically pleasing covering of the opening.

For the purpose of freedom from play, despite sufficient space for the introduction of the thin sheet metal probe 49*a*, the flap is slightly angled in cross section, according to FIG. 49, in the zone of the projections 48*b* and 48*c*, from the plane of the flap, so that the necessary play is given in the middle zone of the flap. The probe 49*a* can nevertheless engage, by its side edges on the flexible spring section 59*b*.

The fastening of the flat spring element into the opening of the construction element may take place, again, by gluing. On the other hand, for construction elements, especially wood, a fastening by driving in suitable pieces 50*c* or 50*d* may be considered (this last possibility indicated in dot-and-dash in FIG. 48). Within the whole surface of the flat spring element 48*a*, the flexible spring sections 50*b* are stamped free, to their base, on all sides, so that their deformability for the catch connection is given.

At the side edges of the fastening sections 50*c* are formed saw-tooth holding elements, which assure a secure fastening in the material of the construction element. In plastic designs, an imbedding of the fastening section in the material of the construction element, by injection, may be considered.

In the design according to FIGS. 51, 52, again, a flap-form connection member 51*a* with flat heads 51*b* on both sides, for the support against bending and torsion in the openings 53*a* of the construction element (here in the form of a circumferential slot) are provided. In the zone of the flat heads, the bottom of the opening is designed in a straight line, as can be seen from FIG. 53, so that the connection member can be pushed sideways into the openings of both construction elements, without having to bring the construction elements to a greater mutual distance. This permits a mounting and demounting of single construction element within an existing association of construction elements without disassembling the surface or three-dimensional structure.

On the flat heads, in the zone near the bending and torsion neck 51*d* of the connection member, projections 51*c* are formed for the engagement of permanent form-fitting locking elements 52*b*. The bending and torsion neck 51*d* is cut free from these projections by short slots, so that the deformability of the neck is not impaired. The form-fitting locking elements 52*b* are formed by vertical sections of cap-like or bridge-like members 52*a*, which are driven into both opposite sides of the opening cross sections of the construction element openings, and grip over this cross section by their peaks. In this way, the construction element body is reinforced in the zone of the opening, against bending. Flexible spring elements 51*c*, which are made in one piece with the body of the connection member, designed as a stamped part, grip behind the vertical sections of the members 52*a*, after setting in the connection member, and form an easily released catch connection.

We claim:

1. An apparatus comprising a plurality of construction elements of a deformable line, surface or a three-dimensional structure, a connection element joining two of said construction elements and connected with said construction elements and providing for relative motion between said construction elements, each of said construction elements having an opening therein for removably receiving said connection element, a spring element located within said opening for detachably retaining said connection element within said opening, said spring element including a first surface section and at least one flexible spring section engaging said connection element, and means for joining said first surface section of said spring element to its respective construction element.

2. An apparatus as defined in claim 1, wherein said connection element has at least one locking section and said flexible spring section of said spring element abuttingly engages a locking section of said connection element for forming a detachable connection between said construction element and said connection element.

3. An apparatus as defined in claim 2, wherein said flexible spring section of said spring element engages said locking section of said connection element so as to place said flexible spring section in tension for resisting disengagement of said construction element and said connection element.

4. An apparatus as defined in claim 2, wherein said flexible spring section of said spring element abuttingly engages said locking section of said connection element so as to place said flexible spring section in compression for resisting disengagement of said construction element and said connection element.

5. An apparatus comprising a plurality of construction elements of a deformable line, surface or a three-dimensional structure, a connection element joining two of said construction elements and connected with said construction elements and providing for relative motion between said construction elements, each of said construction elements having an opening therein for removably receiving said connection element, each of said openings comprising a circumferential slot in said construction element, said slot having an inner periphery extending approximately normal to a lengthwise axis of said connection element, said connection element having an edge abuttingly engaging said inner periphery of said slot for resisting inward movement of said connection element, locking means for resisting movement of said connection element within said slot in a direction normal to the lengthwise axis of said connection element, and means for disengaging said locking means from said connection element.

6. An apparatus as defined in claim 5, wherein said locking means comprises a U-shaped locking element having two legs and a head section, said legs disposed within second slots of said construction element, said head section lying outwardly of a recess in said connection element for preventing said connection element from disengaging from said construction element, wherein said means for disengaging said locking element from said connection element defines an edge of said recess and is movable so as to lie inwardly of said head section of said locking element for removing said connection element from said head section of said locking element for disengaging said connection element from said construction element.

7. An apparatus as defined in claim 6, wherein said connection element comprises an elastic or soft plastic body which has a lengthwise axis and which twists about said axis thereby providing for relative motion between said construction elements.

8. An apparatus as defined in claim 7, wherein said connection element has a second axis extending generally perpendicularly to said first lengthwise axis, and wherein said connection element bends about said second axis for providing relative motion between said construction elements.

9. An apparatus as defined in claim 8, wherein said connection element has a third axis extending generally perpendicularly to each of said first and second axes and wherein said connection element bends about said third axis for providing relative motion between said construction elements.

10. An apparatus comprising a plurality of construction elements of a deformable line, surface or a three-dimensional structure, a connection element joining two of said construction elements and connected with said construction elements and providing for relative motion between said construction elements, each of said construction elements having an opening therein for removably receiving said connection element, said connection element comprising an elastic or soft plastic body having a lengthwise axis and wherein said connection element twists about said axis providing for relative motion between said construction elements, and means for detachably retaining said connection element within said opening comprising a spring element including a first surface section fixedly joined to said construction element and at least one flexible spring section.

11. An apparatus as defined in claim 10, wherein said connection element has at least one locking section and said flexible spring section of said spring element abuttingly engages a locking section of said connection element for forming a detachable connection between said construction element and said connection element.

12. An apparatus as defined in claim 11, wherein said connection element has a second axis extending generally perpendicularly to said first lengthwise axis, and wherein said connection element bends about said second axis for providing relative motion between said construction elements.

13. An apparatus as defined in claim 12, wherein said connection element has a third axis extending generally perpendicularly to each of said first and second axes and wherein said connection elements bends about said third axis for providing relative motion between said construction elements.

* * * * *